United States Patent [19]

Wilkinson

[11] 4,388,044

[45] Jun. 14, 1983

[54] WATER STORAGE TANK

[76] Inventor: Paul Wilkinson, Rte. 4, Asheville Hwy., Knoxville, Tenn. 37914

[21] Appl. No.: 174,614

[22] Filed: Aug. 1, 1980

[51] Int. Cl.[3] ..... F04B 49/08

[52] U.S. Cl. ..... 417/38; 92/132; 92/134; 92/136

[58] Field of Search ..... 417/38, 44, 540, 542, 417/328; 60/413, 416, 418, 469, 39.48; 92/136, 134, 131, 130, 132; 137/392, 386

[56] References Cited

U.S. PATENT DOCUMENTS

| | | | |
|---|---|---|---|
| 2,681,012 | 6/1954 | Hackman | 417/328 |
| 2,851,011 | 9/1958 | Chasser | 92/132 X |
| 2,858,672 | 11/1958 | Clark | 60/39.48 X |
| 2,926,492 | 3/1960 | Flanagan | 60/39.48 |
| 3,243,958 | 4/1966 | Ruchser | 60/413 X |
| 3,318,247 | 5/1967 | Yost | 417/38 |
| 3,738,775 | 6/1973 | Strickland | 417/38 |
| 3,804,125 | 4/1974 | Sonneman | 417/540 X |
| 3,851,661 | 12/1974 | Fernandez | 417/540 X |
| 3,994,624 | 11/1976 | Plunkett et al. | 417/38 |
| 4,278,403 | 7/1981 | Shafer | 417/38 |

FOREIGN PATENT DOCUMENTS

| | | | |
|---|---|---|---|
| 468961 | 2/1914 | France | 417/38 |
| 810317 | 12/1935 | France | 417/185 |

*Primary Examiner*—Edward K. Look

*Attorney, Agent, or Firm*—Pitts, Ruderman & Kesterson

[57] ABSTRACT

A liquid storage tank for providing a liquid under pressure in such a way that pressurized air will not be absorbed by the liquid is disclosed. According to one embodiment of this invention, the pressurized storage tank of this invention having side walls and an end wall uses a plunger or a plate having a seal which is biased to move within the tank as water or liquid is forced into the tank or withdrawn from the tank. According to this embodiment, springs may be positioned in different arrangements and used to provide the bias that maintains the water or liquid under pressure. Still other embodiments use mass or weight while still others use power actuated means or air pressure for providing the necessary bias. In other embodiments of the invention, the tank may include a seal and/or a collapsable liner to prevent any of the liquid from passing the plunger or piston. The addition of a collapsable liner is especially useful if the liquid to be maintained under pressure is corrosive.

8 Claims, 7 Drawing Figures

FIG. 1
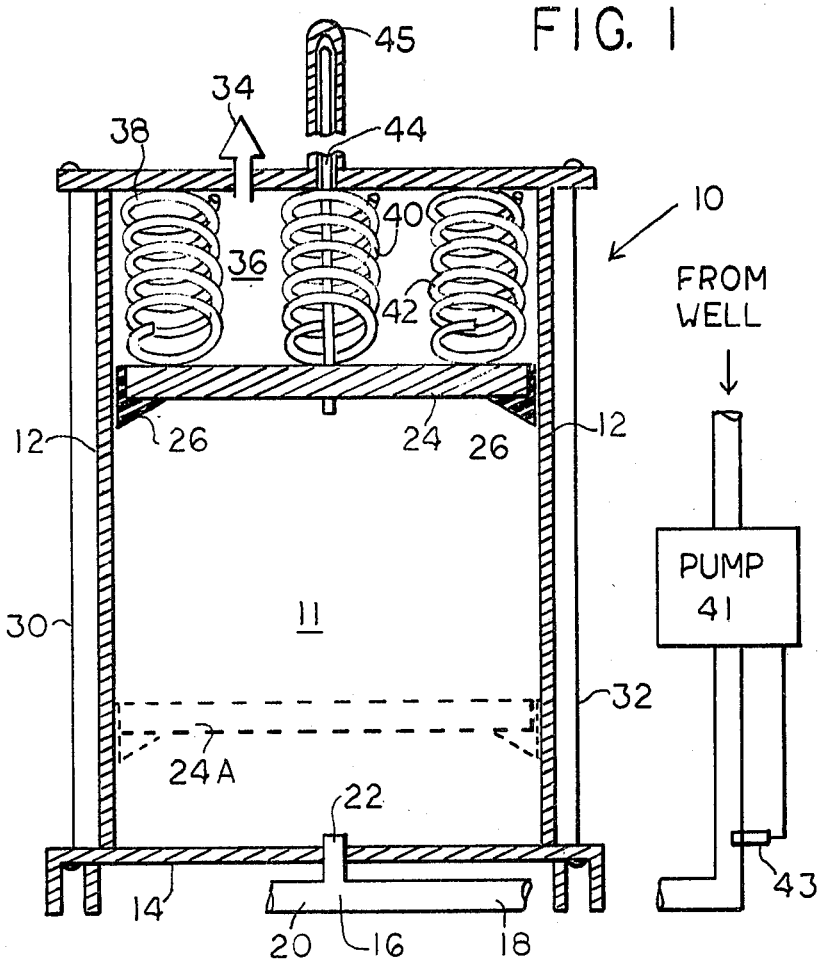
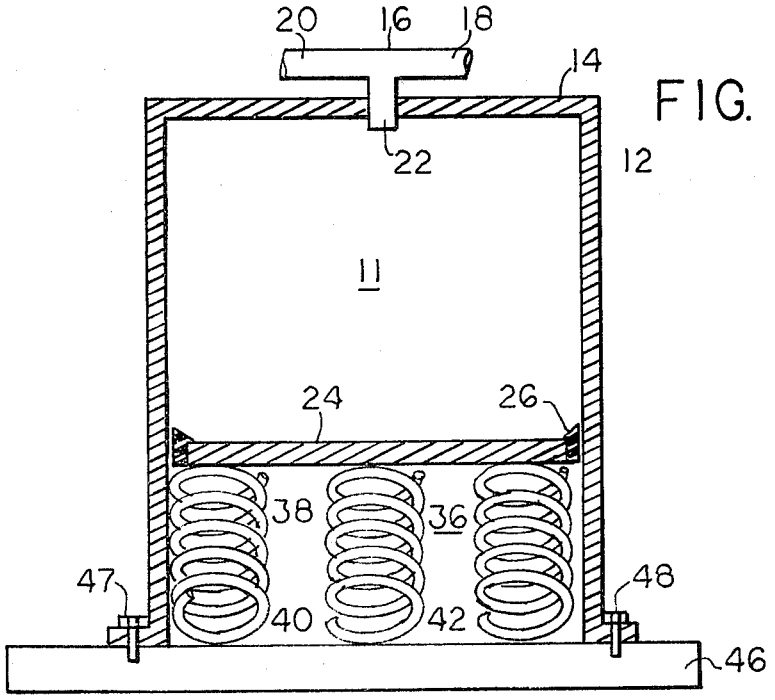
FIG. 2

WATER STORAGE TANK

BACKGROUND OF THE INVENTION

The present invention relates to pressurized liquid storage tanks in general and more particularly to liquid storage tanks which use a biased plunger or means other than air pressure to maintain the liquid under the desired pressure.

Water storage tanks have, of course, been around for eons, including for example the simple gravity type, wherein rain water collected from the eaves of a roof is stored in a tank or cistern in the attic and then provided to the user at a lower level. However, such a technique is not suitable for water obtained from a well unless the water is first pumped to a level higher than the using facility. Since a huge or tall water tower is not always desirable, other techniques of storing water so that it would be available for use throughout a building, were found to be necessary. To this end water is often stored under pressure. To obtain the desired pressure, early water tanks were simply air tight tanks which included enclosed air under pressure as well as water. This pressurized tank is connected directly to the water system. Therefore, according to this system, the tank is first pressurized with air so that as water is forced by the well pump into the tank, the air would be further compressed. The pump continues to force water into the tank displacing the air, until the compressed air in the tank itself exerts as great a force as is provided by the pump. When water is withdrawn from the tank the water leaves the tank under pressure until the water level is reduced to a level, where the air pressure against the water within the tank is reduced to a level sufficient to activate a pressure switch which in turn activates the water pump. Such pressure tanks have significant disadvantages in that the compressed air within the tank will be absorbed by the water. This results in a condition where very little air can be withdrawn from the tank before the pressure is dropped to a point whereby the pump must again be activated. Thus, after a period of time and because the air is absorbed by the liquid, little air remains to be compressed, which causes continuous cycling of the pump. This in turn results in heavy wear and eventual malfunction of the pump. In addition, even under the best of conditions the actual amount of water that can be withdrawn from this type pressure tank constitutes a very small percentage of the actual tank volume. For example, a 42 gallon capacity tank properly charged with air will only hold approximately 20 gallons of water which in turn can be drawn down only about 6 gallons before the pump will reactivate.

To overcome some of the deficiencies of this type air pressure tank, improvements which use a bladder or diaphram within the tank to separate the air from the liquid are available. For example, by providing two compartments, one for air and one for water, which compartments are separated by a flexible diaphragm the mixing of air and water can be avoided. For example, see U.S. Pat. No. 2,594,833 issued to S. M. White on Apr. 29, 1952 and U.S. Pat. No. 3,346,014 issued to C. Jacuzzi on Oct. 10, 1967. Each of these patents, show the two compartment tank using a flexible diaphragm between the two tanks to prevent the mixing of air and water. The White patent further includes a perforated inflexible metal separator to prevent over stressing of the flexible diaphram to prevent early failure. In a similar manner, the Jacuzzi patent includes a bellows type diaphram so that it is not stretched. However, even this type of diaphram still requires flexing during operation. Unlike the present invention both of these two patents rely completely on the use of air pressure for operation. However, U.S. Pat. No. 3,487,855 issued to J. W. Lautenberger on Jan. 6, 1970 discloses a pulsation dampner for controlling the pulsating or water hammer effect of a liquid system under pressure by means of a piston device which receives pressure from the system on both sides of the piston. However, according to this patent, one side is provided with smaller tubing.

SUMMARY OF THE INVENTION

Therefore, it is an object of the present invention to provide a heavy duty self-contained pressure system suitable for substantially all liquid systems, and which does not permit compressed air to be absorbed by the stored liquid.

It is a further object of this invention to provide a pressurized liquid tank which requires significantly less space than tanks available heretofore.

It is yet another object of the present invention to provide a pressurized liquid tank which allows a high level of drawn down before the pressure in the tank is reduced and has to be replenished with additional liquid.

Briefly, the pressurized tank of this invention comprises a tank having an end wall and side walls which define a liquid storage container. The liquid storage container has a selected cross-section which extends between a first portion and a farther portion along a travel axis which is perpendicular to and extends the length of the cross-section. The tank further includes means, such as a "T fitting" for receiving and discharging the liquid, which T-fitting is connected to the end wall. A plunger having an outside shape corresponding to the cross-section of the tank maintains a sliding fit of the plunger within the liquid storage container. The plunger moves along the travel axis between the first and farther portions so that the volume of the container available for liquid storage is reduced as the plunger is moved from said first to said farther portion. The system further includes a biasing means for urging the plunger toward the farther portion of the tank thereby maintaining pressure on the liquid. The apparatus may also, of course, include a seal between the plunger and the tank walls to prevent liquid from moving pass the plunger. In still another embodiment, a collapsable liner is included within the liquid storage volume to also provide protection of the system from the liquid. Such protection would be extremely valuable if the liquid itself was corrosive. The biasing means used to move the plunger and maintain the liquid under pressure may be a massive weight which sets on top of the liquid to provide pressure or alternatively air pressure or various type of springs arranged such that the liquid is maintained under pressure may be used. Still other techniques include power actuated devices such as motor driven racks and/or hydraulic systems for maintaining the liquid under pressure. Yet another technique comprises the use of an electro-magnet located within the tank itself for drawing the plunger to itself thereby reducing the liquid storage area. A particularly effective system is a combination of air pressure with either weight, springs, or an electro-magnet providing the necessary bias.

BRIEF DESCRIPTION OF DRAWINGS

FIG. 1 is a cross-sectional view of a tank of this invention using compression springs located between an end member of the tank and the movable plunger for maintaining pressure on the liquid therein.

FIG. 2 is a cross-sectional view of a tank of this invention showing compression springs located between a floor support member and the plunger for maintaining the liquid in the tank under pressure.

DESCRIPTION OF THE INVENTION

Figure 3:
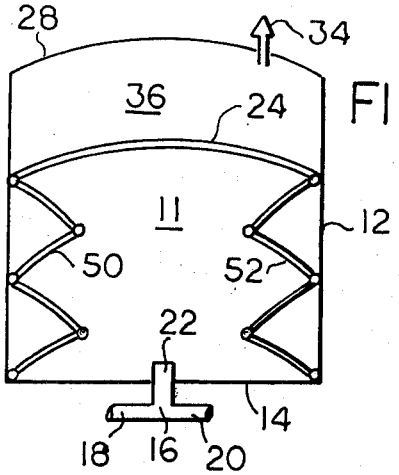
FIG. 3 shows a cross-section view of another embodiment of this invention wherein tension springs are located within the liquid container itself for maintaining the liquid under pressure.

Referring now to FIG. 1, there is shown generally at 10 an embodiment of the system of the present invention having a tank or liquid container 11 formed by side walls 12 and an end wall 14. It will be appreciated that although any cross-section could be used, it may be more advantageous to use a cylindrical cross-section for ease of manufacture and assembly. Connected to end wall 14 is a receiving and discharging means which as shown may be simply be a "T" shaped connector which receives liquid from a pump or well (not shown) connected to end 18, which in turn provides liquid to a using system by means of pipe 20. The leg 22 of the "T" opens into the tank or container 11 wherein the liquid is to be stored. In the figure as shown, the side walls 12 may be mounted to the end wall 14 in any suitable manner such as by welding, bonding, or other means such that they are liquid tight. However, it will also be appreciated that the end wall could itself be molded or formed as a single unit with the side walls. This is especially true in the case of a tank having a cylindrical cross-sectional area. Thus, it can be seen that the side walls 12 and the end wall 14 provide a tank or liquid container 11, but which without more would not be under pressure. Therefore, the pressure of the liquid is provided by means of a plate or plunger 24, which plate or plunger has a cross-section corresponding substantially to the cross-section defined by the side walls 12 and moves along a travel axis 25. Also included is a seal 26 which is located between the plunger 24 and the side walls 12. It will be appreciated that the seal 26 could be made of any suitable flexible material such as nylon, polyethelene, leather, rubber or the like. In the embodiment shown, a top or end member 28 is located at the end of the walls 12 and opposite the end wall 14. For purposes of strength and support, and to withstand the pressure which may be required by the biasing means to be discussed hereinafter, the present embodiment shows straps 30 and 32 which may be included to securely maintain end member 28 in the proper location. According to certain embodiments of this invention, a complete air tight seal is not required of end member 28, and to assure the free movement of the plunger in the event a cap is used, there is also shown an air control device 34 to allow the free movement of air into the air space 36. However, as will be discussed hereinafter, other embodiments operate in conjunction with compressed air as the biasing means. In such embodiments, air control device 34 may operate as a valve for providing pressurized air. Also included in this embodiment are compression springs 38, 40 and 42 for biasing the plate 24 against the liquid contained in tank or container 11. A plunger and a guide shaft 44 and 45 respectively may be used to maintain the plunger in a substantially horizontal location. It will be appreciated, that although springs 38, 40, and 42 are shown as helical compression springs, many suitable springs including leaf springs could be used. Also, of course, rather than three springs a variety of sizes and numbers of springs would also be appropriate. The amount of spring force required will, of course, depend upon the desired pressure of the liquid within the liquid container or tank 11. Also as will be discussed hereinafter, compressed air located in chamber or air space 36 may operate in combination with springs 38, 40 and 42 as the bias to provide the necessary pressure to the liquid in the tank or chamber 11. Thus, in operation the pump 41 would typically pump water from a well through pipe 18 into the tank or container 11. The plunger 24 in its initial state would be in a low position such as shown by dotted lines at 24A. As more and more water was introduced into the tank 11, plunger 24 would move along travel axis 25 to the solid line position at the top of the tank at which point a pressure switch 43 would sense that the liquid in the system was at the desired pressure. Thus, the pump would cut off and no further liquid would be introduced into the tank 11. Upon need, water or liquid would be withdrawn from tank 11 through pipe 20 and the liquid would be maintained under pressure by the plunger 24 responsive to the springs 38, 40, and 42. As liquid was withdrawn plunger 24 would move downward along travel axis 25.

Referring now to FIG. 2, there is shown another embodiment of the present invention. Components shown in FIG. 2 which are similar to those in FIG. 1, previously discussed, maintain the same reference numbers. As shown, FIG. 2 is similar to FIG. 1 except that the tank is inverted. That is, the receiving and discharging means 16 is at the top of the tank and plunger 24 is at the bottom of the tank. The side walls 12 are securely mounted to a floor support member 46 by means of bolts or studs such as shown at 47 and 48. In this embodiment, the springs 38, 40, and 42 are between floor support member 44 and plate or plunger 24. Thus, as liquid is pumped into tank 11 through receiving/discharging means 16, springs 38, 40 and 42 are compressed. As liquid is drawn from service, springs 38, 40, and 42 urge the plunger 24 along travel axis 25 towards the end plate 14 to maintain the liquid under pressure. Again as was mentioned with respect to FIG. 1 and as will be discussed, hereinafter, compressed air located in air space 36 could be used in combination with springs 38, 40 and 42 to provide the necessary biasing.

Referring now to FIG. 3, there is shown still another embodiment of the present invention. As can further be seen in this embodiment, tension springs such as shown at 50 and 52 and located within the tank or container 11, tend to hold the plunger 24 in a lowermost position. As can be seen in this example, however, plunger 24 may be domed or saucer shaped. Such a shape, helps maintain contact of the plate 24 with sidewalls 12. As shown, leaf type springs are used at 50 and 52, but it will be appreciated, of course, that helical tension springs could be used. Again, of course, compressed air could be provided in air space 11 to help provide the necessary biasing.

Figure 4:
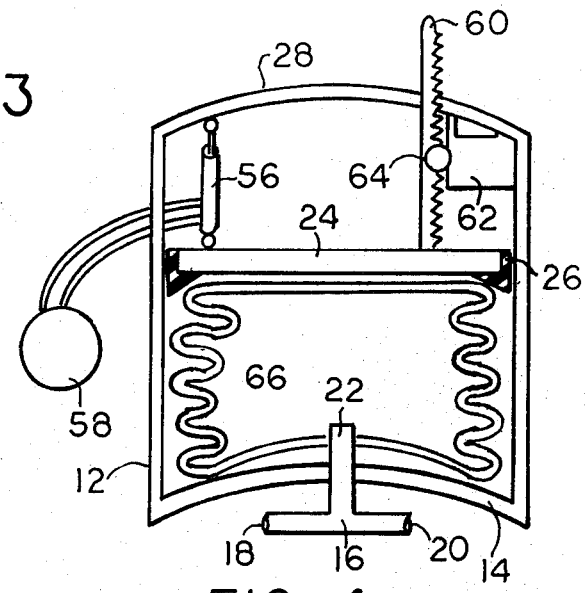
FIG. 4 is a cross-section of tank of this invention wherein the plunger maintains pressure on the liquid contained in the storage volume by means of power actuators such as hydraulic cylinders and/or rack and pinion drives.

Still another embodiment is shown in FIG. 4. According to the embodiment of FIG. 4, the primary biasing means rather than being springs could be a hydraulic cylinder 56 which is shown being powered by a hydraulic pump 58. Alternatively, another power actuating source could be simply a rack member 60 attached to plate 24. The rack 60 is driven by means of an electrical motor 62 and gear box 64. Thus, according to this embodiment, the desired pressure can be maintained by a power actuating device. The embodiment of FIG. 4 also shows the use of a collapsable liner 66 for maintaining the liquid in the tank 11. The use of a collapsable liner is especially desirable if the liquid is corrosive to help prevent any contamination or leakage.

Figure 5:
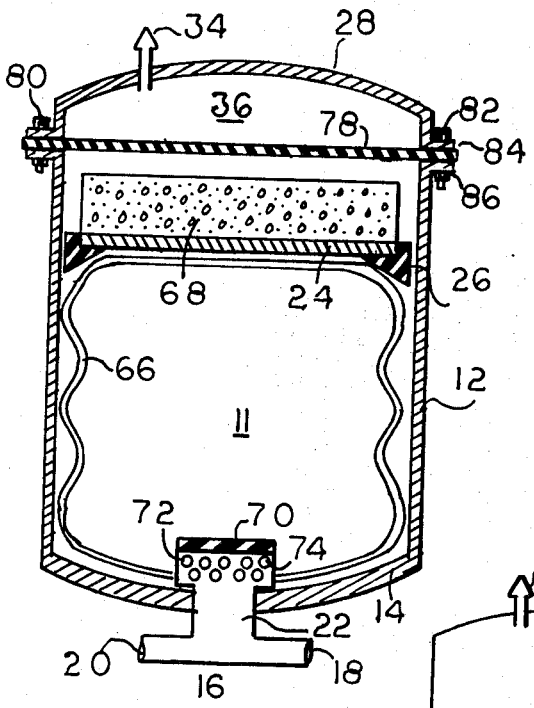
FIG. 5 shows a cross-section of the tank of the present invention wherein the plunger is maintained under a heavy weight to provide the pressurization to the liquid contained therein.

Referring to FIG. 5, there is shown a very simple embodiment of the present invention wherein the plunger 24 sliding within side walls 12 uses as its biasing means a mass or weight 68 to maintain the desired pressure on the liquid in tank 11. The weight 68 can be of any suitable heavy material, but is preferably made of an inexpensive material such as sand, concrete, or the like. Also as shown in FIG. 5, leg 22 of receiving/discharging means 16 which opens into tank 11 may also include a rubber stop 70 upon which plunger 24 may come to rest if sufficient liquid is withdrawn to allow the plunger to move to that extent. Also shown are perforations 72 and 74 to allow liquid to move in and out of means 16. This embodiment is especially suitable for working in combination with compressed air in space 36 to provide the necessary biasing.

Figure 6A:
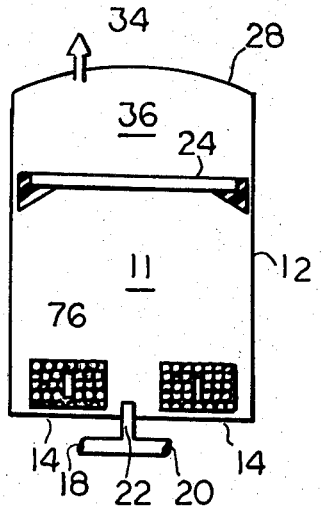
FIGS. 6A and 6B show a cross-section of the tank of the present invention wherein an electro-magnet is used to attract the plunger thereby providing the pressure to the liquid contained therein.
Figure 6B:
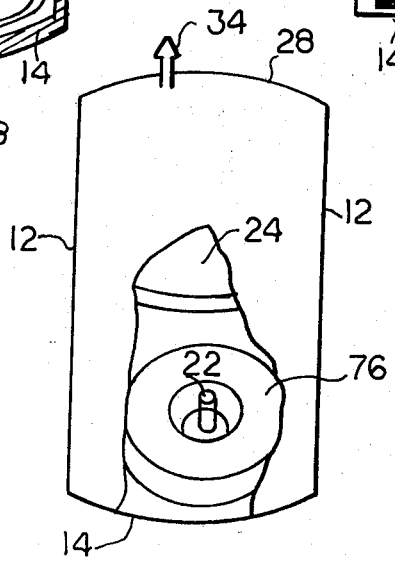

Referring now to the cross-sectional view of FIG. 6A and the perspective cut away view of 6B, there is shown still another embodiment for obtaining the desired biasing means. According to this embodiment, electro-magnet 76 is located in the bottom of the tank 11 against end plate 14. In this embodiment tank walls 12, and end plate 14 are preferably made of a nonmagnetic material, whereas, plunger 24 is made of a magnetic material such that the electro-magnet 76 attracts plunger 24 thereby providing the necessary pressure to the liquid contained in container 11. Since the pressure provided by electro-magnet 76 will be inverse with respect to the distance of the plunger, it may also be desirable to include some other biasing means such as springs or compressed air in space 36 to provide the pressure when plunger 24 is at its extreme travel away from end plate 14.

Thus, it will be appreciated that there have been described various embodiment of the present invention for providing necessary force or biasing means to maintain the liquid under pressure. However, as has been mentioned, compressed air may also be used either by itself or in combination with the previous described biasing means to obtain the necessary liquid pressure. In order that compressed air may be used, it is necessary, of course, that the air space 36 be air tight. Referring again to FIG. 5, it will be appreciated that to maintain compressed air in space 36, end member 28 must be joined to side walls 12 with an air tight joint. This can, of course, be accomplished in any suitable manner, including a seal 78 and series of bolts such as shown at 80 and 82 which joins flanges 84 and 86. End member 28 could also simply be welded to side walls 12, but such construction would complicate repairs etc. It is believed that even if compressed air is used in this manner along with another type of biasing means the absorption of air by the liquid is prevented even if a liner 66 is not used. This is because the pressure of the liquid which is under pressure due to both the compressed air and the weight is greater than the air pressure alone. Thus, any air which possibly seeped around seal 26 would be at less pressure than the liquid and therefore the air would not be absorbed by the liquid.

It will further be appreciated that in the embodiment, the tank may be made of any suitable material including steel or metal or in some cases fiberglass or other materials.

Thus, although the present invention has been described with respect to specific embodiments it is not intended that such specific references be considred as limitations of the scope of the invention except insofar as set forth in the following claims.

I claim:

1. A liquid delivery system for pumping a liquid from a supply source to a storage tank, and continuously maintaining said liquid in said storage tank under pressure within a selected range of pressures comprising:

a storage tank comprising an end wall and side walls defining a liquid storage container, said liquid storage container having a cross-section of a selected shape and selected area extending between a first and farther portion, and a travel axis perpendicular to and extending the length of said selected cross-section, said tank further including liquid receiving and discharging means connected to said end wall;

a plunger having a first side and a second side, and an outside shape corresponding to said selected cross-section for providing a sliding fit of said plunger within said liquid storage container along said travel axis and between said first and farther portions such that said first side contacts said liquid contained therein and encloses said liquid storage container so that the volume of said liquid storage container is reduced as said plunger moves from said first portion to said farther portion, and wherein the area of both said first and second sides of said plunger which is perpendicular to said travel axis is equal to said selected area;

an end member secured to said side walls to provide an air tight seal therebetween such that compressed air between said end member and said second side of said plunger provides a first biasing means for urging said plunger towards said farther portion;

a collapsible liquid impervious liner located within the liquid storage container and connected to said receiving and discharging means such that any liquid provided to said storage tank by said receiving means is contained completely within said liner;

second biasing means for urging said plunger towards said farther portion;

a pump to receive liquid from said supply source, and to force said liquid into said tank through said liquid receiving and discharging means such that said plunger is moved against said first and second biasing means from said farther portion towards said first portion; and a pressure switch to turn said pump on and off as the pressure of said liquid in said tank varies between said selected range of pressure.

2. The apparatus of claim 1 wherein said second biasing means comprises a spring connected to urge said plunger toward said farther portion.

3. The apparatus of claim 2 wherein said spring is a compression spring located between said end member and said second side of said plunger.

4. The apparatus of claim 2 wherein said spring is a tension spring connected between said end wall and said first side of said plunger inside said liquid storage container.

5. The apparatus of claim 2 wherein said end member is a support floor.

6. The apparatus of claim 1 wherein said tank is oriented such that said plunger is the top most portion of said liquid containing tank and said biasing means is a mass of material supported by said plunger for providing weight on top of said liquid in said liquid containing tank.

7. The apparatus of claim 1 wherein said biasing means is a power actuating means connected between said end member and said plunger.

8. The apparatus of claim 1 wherein said tank walls are made of a non-magnetic material and said plunger is made of a magnetic material, and further including an electro-magnet within said liquid storage container and adjacent said end wall such that when the said electro-magnet is activated said plunger is attracted toward said electro-magnet.

* * * * *